US005218802A

United States Patent [19]

Yoshimura et al.

[11] Patent Number: 5,218,802

[45] Date of Patent: Jun. 15, 1993

[54] COLUMN AND BEAM CONNECTING ASSEMBLY

[75] Inventors: Masahiro Yoshimura; Hirooh Tominaga, both of Tokyo; Hideshige Matsuo; Takashi Kitano, both of Kitakyushu; Atsushi Yamada, Tokyo, all of Japan

[73] Assignees: Shimizu Construction Co., Ltd.; Hitachi Metals, Ltd.; Hitachi Metals, Techno Ltd., all of Tokyo, Japan

[21] Appl. No.: 640,483

[22] Filed: Jan. 14, 1991

[30] Foreign Application Priority Data

Jan. 16, 1990 [JP] Japan ..... 2-6711
Jan. 16, 1990 [JP] Japan ..... 2-6712

[51] Int. Cl.[5] ..... E04B 1/20

[52] U.S. Cl. ..... 52/253; 52/263; 52/721; 52/728

[58] Field of Search ..... 52/250, 251, 253, 262, 52/263, 720, 721, 723, 252, 728

[56] References Cited

U.S. PATENT DOCUMENTS 1,571,092 1/1926 Lally .
3,354,593 11/1967 Zukas ..... 52/251
3,593,477 7/1971 Briggs ..... 52/723 X
4,211,045 7/1980 Koizumi et al. ..... 52/251
4,577,449 3/1986 Celli ..... 52/721
4,722,156 2/1988 Sato ..... 52/98
4,864,797 9/1989 Sato et al. ..... 52/721 X
4,905,436 3/1990 Matsuo et al. ..... 52/721 X
5,012,622 5/1991 Sato et al. ..... 52/263 X

FOREIGN PATENT DOCUMENTS 0218313 4/1986 European Pat. Off. .
190838 1/1988 Japan .
190839 1/1988 Japan .

*Primary Examiner*—Carl D. Friedman
*Assistant Examiner*—Kien Nguyen
*Attorney, Agent, or Firm*—Darby & Darby

[57] ABSTRACT

A connecting assembly is disposed between a concrete column and at least one beam having upper and lower flanges. The connecting assembly has upper and lower connecting members and a tubular member disposed between the connecting members. The upper and lower connecting members are mounted on the upper and lower flanges of the beam, respectively. Each of the connecting members has at least one through-hole in which concrete of the column is filled, so that the column is partly encased by the tubular member. Accordingly, the column is connected to the beam.

8 Claims, 7 Drawing Sheets

COLUMN AND BEAM CONNECTING ASSEMBLY

BACKGROUND OF THE INVENTION

1. Field of the Invention

The present invention pertains to a connecting assembly between a column and at least one beam.

2. Prior Art

For a conventional connecting assembly between a column and a pair of beams, Japanese Patent Application Publication (Kokai) No. 1-190838 is cited. This connecting assembly is described with reference to FIGS. 11 and 12 of the present accompanying drawings. The connecting assembly 30 is disposed in a concrete-filled steel pipe column 31 of a square cross section, and more specifically, the connecting assembly 30 is located in a space 32 between a pair of coaxially aligned steel pipe portions of the column 31. In the space 32, a diaphragm 33 made of steel by pressing or casting intermediates. Through-holes 34 are formed at the center and at the four corners of the diaphragm 33; concrete is filled in the through-holes 34 so that the diaphragm 33 is mounted to the column 31 in such a manner that the concrete is united with the steel pipes and the diaphragm 33. The diaphragm 32 includes a projecting flange 35 around it, forming a square. The flange 35 includes a pair of projections 36 at the opposite sides thereof. In the drawings, only one diaphragm 33 is shown. However, another diaphragm 33 is mounted below the shown diaphragm 33 in a manner similar to the described diaphragm 33. A pair of beams 37 are unitarily welded to the diaphragm 33 and the steel pipe. The beams 37 are wide flange I-beams, in which the flanges are welded to the projections 36, respectively. Consequently, the beams 37 are connected to the column 31.

However, in the above connecting assembly, the following problems are present:

The flanges or the upper and lower ends of the beams 37 are welded to the projections 36 of the upper and lower diaphragms 33. Accordingly, the positioning of one of the diaphragms 33 must be accurate with respect to the other diaphragm 33. That is, the interval between the diaphragms 33 must be equal to the interval of the upper and lower ends of the beams 37 in order to achieve the rigid connection between the column 31 and the beams 37 by welding. This positioning is very difficult, and thus the productivity is low and the rigidity of the connecting assembly is likely to be poor.

For this reason, the connecting assembly can be applied as long as the column 31 comprises a steel pipe. However, if the steel pipe is not used, the connecting assembly may not be adequate since the flange of the beams 37 may not be supported without sufficient rigidity.

SUMMARY OF THE INVENTION

It is therefore an object of the present invention to provide a connecting assembly between a column and at least one beam in which the dimensional accuracy of the assembly is enhanced, thus increasing the productivity and the rigidity of the assembly while the workability of filling the concrete into the connecting assembly is facilitated.

In accordance with one aspect of the present invention, a connecting assembly is disposed between a concrete column and at least one beam. The beam has upper and lower flange portions. The connecting assembly comprises upper and lower connecting members and a tubular member disposed between the connecting members. The upper and lower connecting members are mounted on the upper and lower flange portions of the beam, respectively. Each of the connecting members has at least one through-hole in which concrete of the column is filled, so that the resulting column is partly encased by the tubular member. Accordingly, the column is connected to the beam.

With such a structure, the interval between the upper and lower connecting members for mounting the upper and lower flange portions of the beam is defined by the size of the tubular member, thereby enhancing the dimensional accuracy of the connecting assembly. Consequently, the productivity is increased and the rigidity of the connecting assembly are ensured.

BRIEF DESCRIPTION OF THE DRAWINGS

The foregoing and further objects, features, and advantages of the present invention will be understood more completely from the following detailed description of the preferred embodiments of the present invention, with reference to the accompanying drawings, in which.

DESCRIPTION OF THE PREFERRED EMBODIMENTS

With reference to the accompanying drawings, preferred embodiments of the present invention will be described in detail.

First Embodiment

Figure 1:
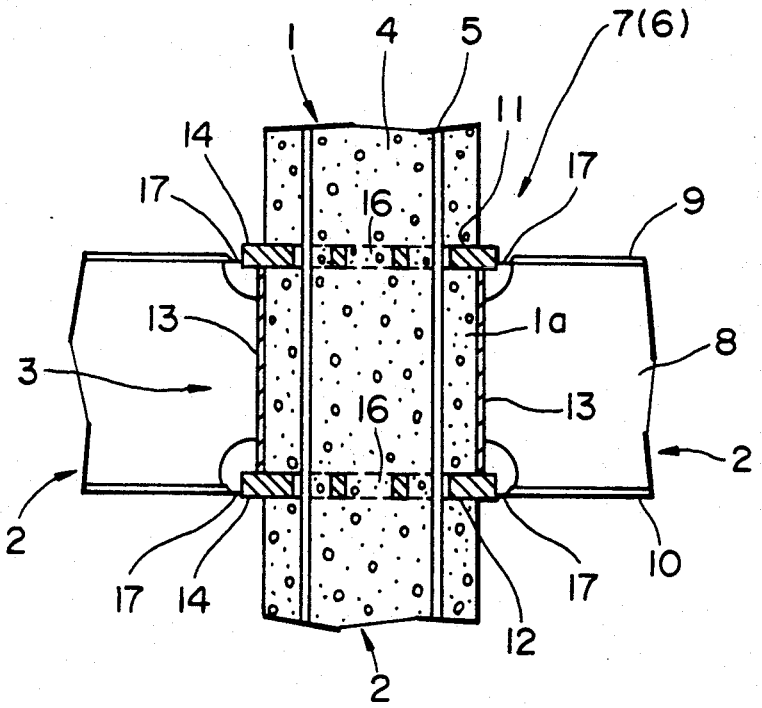
FIG. 1 is a cross sectional view of a connecting assembly between a column and beams in accordance with a first embodiment of the present invention.

FIG. 1 depicts a connecting assembly 3 between column 1 and a pair of beams 2, according to an embodiment of the present invention.

The connecting assembly 3 is disposed in and mounted on the column 1. The column 1 comprises a concrete column body 4 of a generally square cross section in which reinforcements 5 are disposed. The column 1 is erected vertically and the reinforcements 5 are also arranged vertically. The column 1 comprises an upper portion and a lower portion which are coaxially aligned with each other. A space 6 is disposed between the upper and lower portions. A connecting device 7 is disposed in the space 6, and is mounted on the concrete column 1.

A pair of beams 2 are mounted on the connecting device 7. Each of the beams 2 is an I-beam of which the upper and lower flange portions 9 and 10 are disposed horizontally. The flange portions 9 and 10 are connected through the web portion 8 in a conventional manner.

The connecting device 7 comprises an upper connecting member 11, a lower connecting member 12, and a tubular member 13 disposed between the connecting members 11 and 12. Each of the connecting members 11 and 12, and the tubular member 13 is made of steel and is manufactured unitarily by welding the tubular member 13 to the upper and lower connecting members 11 and 12. The tubular member 13 encases a portion 1*a* of the column 1 which intermediates between, and is united to, said upper and lower portions of the column 1. The upper and lower connecting members 11 and 12 are mounted on and welded to the upper and lower flange portions 9 and 10, respectively. Therefore, the interval between the upper and lower connecting members 11 and 12 is adjusted to the interval between the upper and lower flange portions 9 and 10 when the connecting device 7 is manufactured.

Each of the upper and lower connecting members 11 and 12 has four horizontal projections 17 (see FIG. 9) protruding from the outer periphery of the connecting members. To the projections 17, the flange portions 9 or 10 of the beams 2 are affixed. In this embodiment, both connecting members 11 and 12 have the projections 17. However, it is possible for only one connecting member 11 or 12 to have the projections 17.

Figure 9:
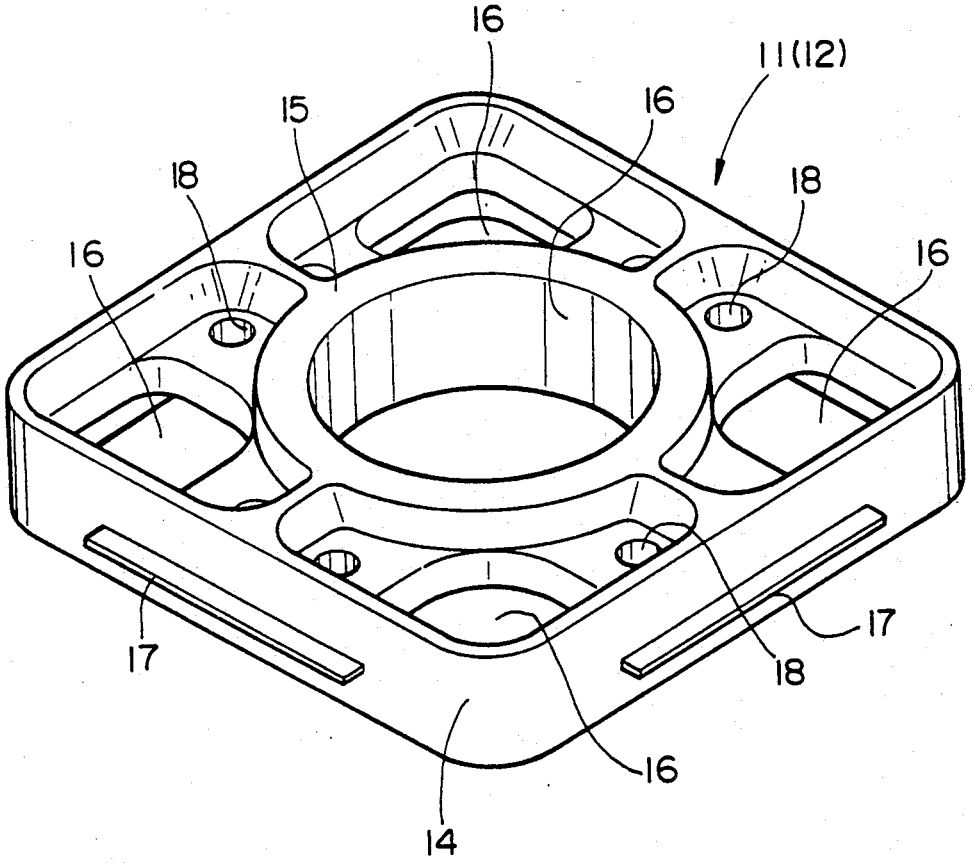
FIG. 9 is a perspective view of a connecting member which may be utilized in the connecting assemblies in FIGS. 1 to 8.

FIG. 9 depicts a connecting member 11 in greater detail. The connecting member 12 is in a form similar to that of the connecting member 11. The connecting member 11 is a diaphragm of a generally square shape. The connecting member 11 includes a square peripheral portion 14 and rib portion 15 disposed within and connected to the peripheral portion 14. The connecting member 11 includes five through-holes 16 through which can be inserted a tremie tube for supplying concrete. The through-holes 16 are disposed at the central portion and the four corners of the connecting member 11. Said projections 17, on which said flange portions 9 (or 10) of the beams 2 are fixed, are disposed on the outer periphery of the peripheral portion 14. Each of the projections 17 is disposed slightly below the center of the outer periphery of the peripheral portion 14. A plurality of through-holes 18 are formed on the connecting member 11 for allowing the escape of air during the pouring of concrete.

The connecting member 11 is manufactured unitarily by casting or pressing. As mentioned above, the connecting member 12 is the same shape as the connecting member 11, and the projections 17 can be excluded from the connecting member 17.

Said steel tubular member 13, which is of a square cross section, is welded to the peripheral portions 14 of the connecting members 11 and 12 unitarily.

Figure 10:
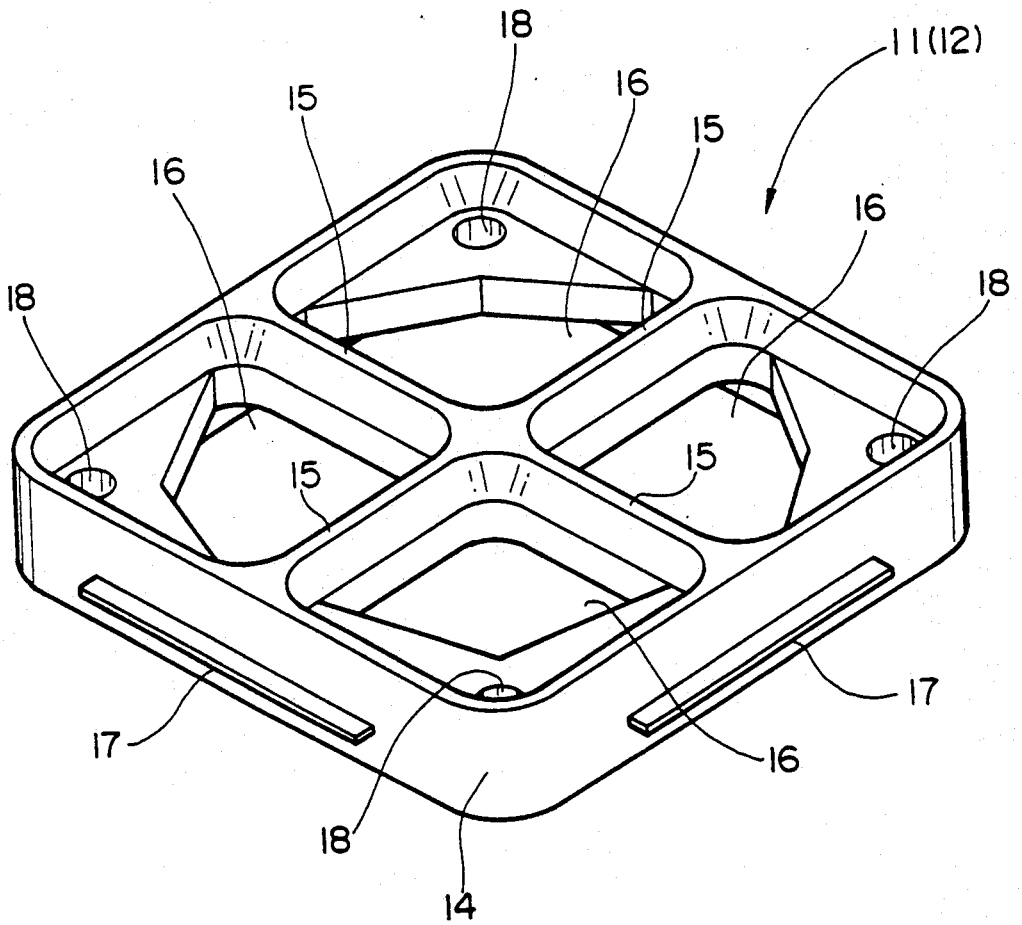
FIG. 10 is a perspective view of another connecting member which may be utilized in the connecting assemblies in FIGS. 1 to 8.
Figure 11:
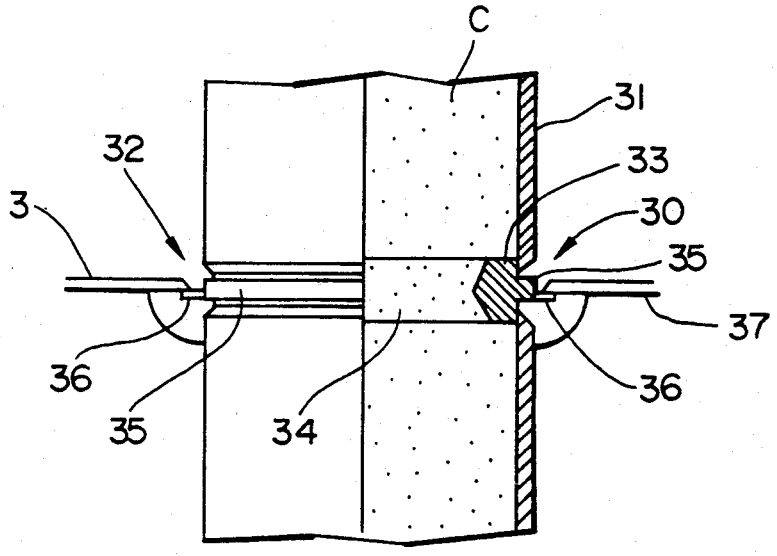
FIG.11 (PRIOR ART)
FIG. 11 is a side view of a connecting assembly between a column and beams of a prior art.
Figure 12:
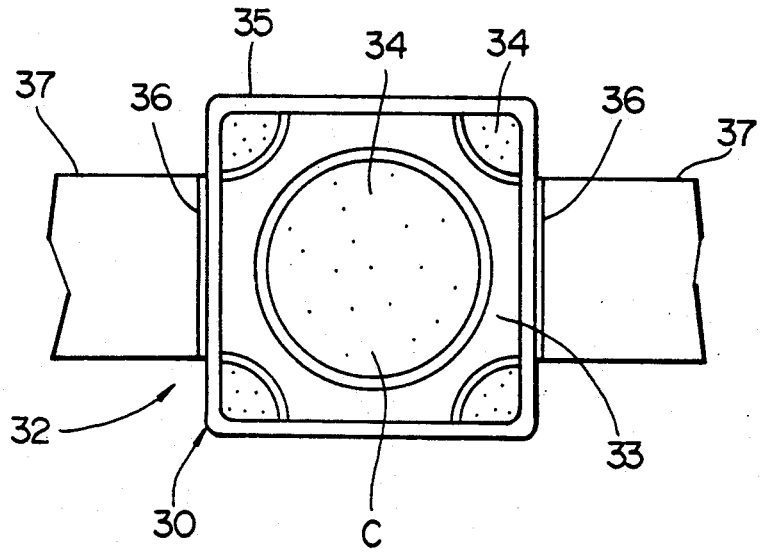
FIG.12 (PRIOR ART)
FIG. 12 is a horizontal sectional view of the connecting assembly in FIG. 11.

Another example of the connecting member 11 (12) is illustrated in FIG. 10. The connecting member 11 is of a generally square shaped diaphragm. The connecting member 11 includes a square peripheral portion 14 and cross-shaped rib portions 15 disposed within and connected to the peripheral portion 14. The connecting member 11 includes four through-holes 16 through which a tremie tube for supplying concrete can be inserted. The through-holes 16 are disposed at the four corners of the connecting member 11. Said projections 17, on which said flange portions 9 (or 10) of the beams 2 are fixed, are disposed on the outer periphery of the peripheral portion 14. Each of the projections 17 is disposed slightly below the center of the outer periphery of the peripheral portion 14. A plurality of through-holes 18 are formed on the connecting member 11 to allow the escape of air from the concrete.

The connecting member 11 is manufactured unitarily by casting or pressing. The connecting member 12 is the same shape as the connecting member 11, and the projections 17 can be excluded from the connecting member 12.

Said steel tubular member 13, which is of a square cross section, is welded to the peripheral portions 14 of the connecting members 11 and 12 unitarily.

The connecting assembly 3 is assembled in the following manner. First of all, the connecting device 7 is installed in the concrete column 1 in such a manner that the reinforcements 5 are disposed along the connecting device 7 and are inserted through the through-holes 16, and the concrete is filled into the tubular member 13 so as to form said intermediate portion 1*a*. Next, the ends of the flanges 9 and 10 of the beam 2 are welded to the outer periphery of the upper and lower connecting members 11 and 12, respectively, in such a manner that the upper and lower flanges 9 and 10 are mounted on the projections 17 of the upper and lower connecting members 11 and 12, respectively. Then, the ends of web portions 8 of the beams 2 are also welded to the tubular member 13. Incidentally, the projections 17 can be excluded from one of the connecting members 11 and 12, as mentioned above.

Also, gusset plates (not shown) may be welded to the tubular member 13, and the web portions 8 of the beams 2 are mounted on the gusset plate by nuts and bolts.

In order to install the connecting device 7 to the column 1, the connecting device 7 is disposed on the lower portion of the column 1 in such a manner that the reinforcements 5 are inserted into the through-holes 16 of the connecting device 7. A concrete forming mold is disposed on the connecting device 7 in order to form the upper portion of the column 1. The tremie tube is inserted into the through-hole 16, so that concrete can flow into the space defined by the tubular member 13 and the forming mold. Consequently, the tubular member 13 and then the forming mold are filled with the concrete 4, thereby constructing the continuous concrete column 1 including said upper, lower, and intermediate portions.

With such a structure, the interval between the upper and lower connecting members 11 and 12 for mounting the upper and lower flanges 9 and 10 of the beams 2 is defined by the size of the tubular member 13, thereby enhancing the dimensional accuracy of the connecting assembly 3. Consequently, high productivity and the improved rigidity of the connecting assembly 3 are ensured.

In addition, there are provided through-holes 16 at each of the connecting members 11 and 12 through which can be inserted a tremie tube for supplying concrete 4. Accordingly, the pouring of the concrete may be performed efficiently.

Furthermore, by virute of the projections 17, on which the flange portions 9 and 10 of the beams 2 are fixed, the productivity is further increased and the rigidity of the connecting assembly 3 are further ensured.

Moreover, since said upper, intermediate, and lower portions of the concrete column 1 can be manufactured unitarily and in a unitary concrete body 4, the concrete column 1 is a superior mechanical strength and rigidity. Thus, the rigidity and strength of the entire connecting assembly 3 can be enhanced.

Second Embodiment

Figure 2:
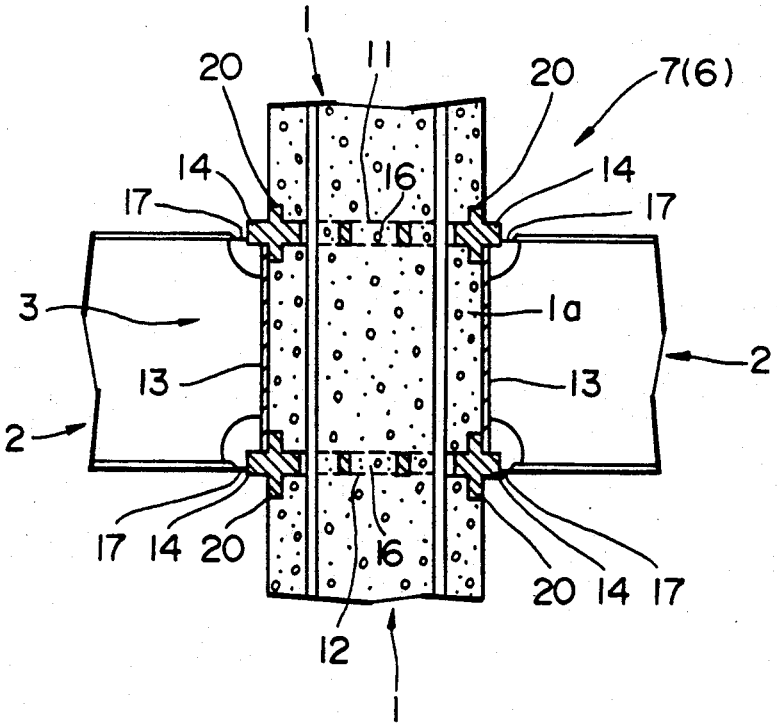
FIG. 2 is a cross sectional view of a connecting assembly between a column and beams in accordance with a second embodiment of the present invention.

FIG. 2 shows a second embodiment of the present invention. In the following description, the same reference signs re attached to the same structural components as in the first embodiment, and the description of such components will be omitted. In the second embodiment, upper and lower axial protrusions 20 are formed on the peripheral portion 14 of each of the connecting members 11 and 12. The axial protrusions 20, protruding along the axis of the column 1, are continuously formed on the peripheral portions 14. The axial protrusions 20 are flush with the upper and lower portions of the column 1. Therefore, the durability of the column 1 is enhanced against a horizontal shearing force to the column 1 or a bending moment to the column 1 around the connecting device 3.

In this embodiment, two protrusions (upper and lower protrusions) 20 are formed at the opposite sides of each of the peripheral portions 14. However, the protrusions 20 may also be formed at one side of each of the peripheral portions 14. If the intention is to improve the durability of the column 1, the protrusions 20 are formed all along the length of the circumferential portion of the column 1. The arrangement of the dimensions can be designed optionally.

Third Embodiment

Figure 3:
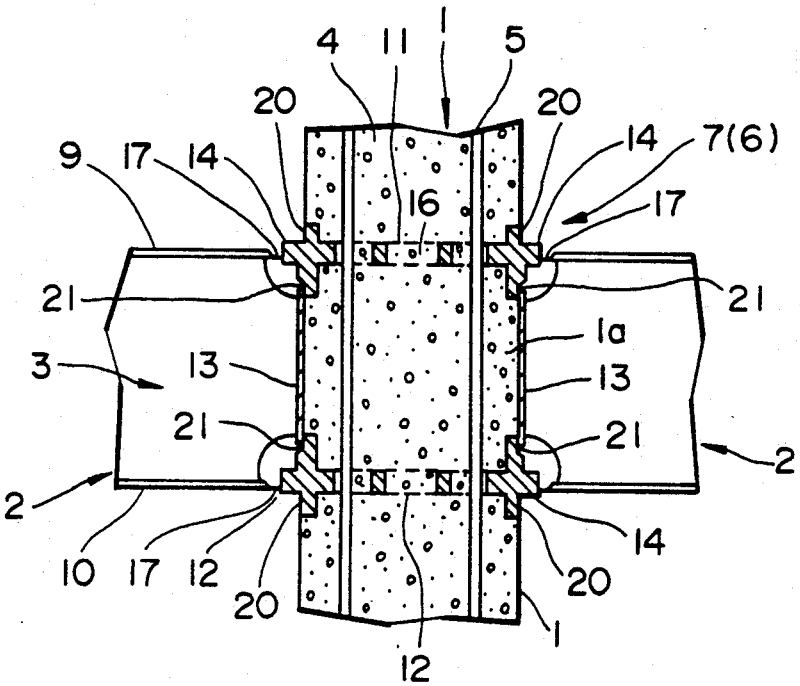
FIG. 3 is a cross sectional view of a connecting assembly between a column and beams in accordance with a third embodiment of the present invention.

FIG. 3 shows a third embodiment of the present invention. The structure of the third embodiment is similar to that of the second embodiment. However, in order to enhance the welding strength between the tubular member 13 and the connecting members 11 and 12, each of the upper and lower connecting members 11 and 12 is provided with an edge preparation 21. That is, the edge preparation 21 is formed at the outer peripheral face of the lower protrusion 20 of the upper connecting member 11 where the tubular member 13 will be welded. The same edge preparation 21 is also formed at the outer peripheral face of the upper protrusion 20 of the lower connecting member 12 where the tubular member 13 will be welded. Each of the edge preparations 21 is a V-shaped notch or groove which is circumferentially formed around the respective peripheral face. By virtue of the edge preparations 21, the tubular member 13 is welded rigidly to the upper and lower connecting members 11 and 12. With this embodiment, since the welding between the tubular member 13 and the connecting members 11 and 12 is ensured, the connecting assembly 7 and thus the connecting assembly 3 can be constructed more rigidly.

Fourth Embodiment

Figure 4:
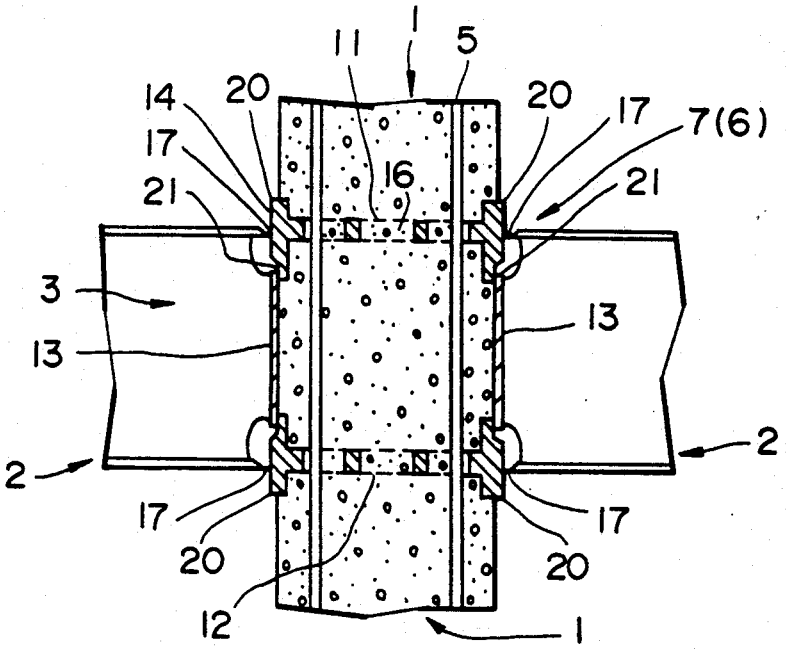
FIG. 4 is a cross sectional view of a connecting assembly between a column and beams in accordance with a fourth embodiment of the present invention.

FIG. 4 depicts a fourth embodiment of the present invention. This embodiment is a modification of the third embodiment. In this embodiment, the outer peripheries of the peripheral portions 14 are flush with the outer periphery of the tubular member 13. Accordingly, said projections 17 for mounting the upper and lower flanges 9 and 10 are excluded from this structure. With such a structure, since there are no projections around the connecting device 7, the positioning of the ends of the beams 2 with respect to the column 1 can be performed easily. Hence, the productivity of the connecting assembly 3 can be enhanced.

Fifth Embodiment

Figure 5:
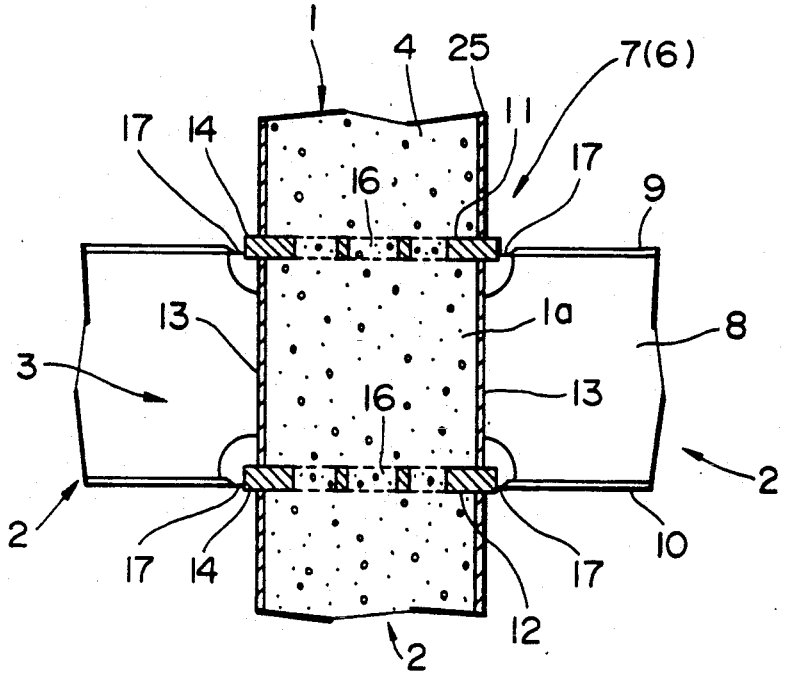
FIG. 5 is a cross sectional view of a connecting assembly between a column and beams in accordance with a fifth embodiment of the present invention.

FIG. 5 illustrates a fifth embodiment of the present invention. This embodiment is a modification of the first embodiment shown in FIG. 1. In the first embodiment, the connecting assembly 3 is applied to the concrete column 1. On the other hand, in the fifth embodiment, the connecting assembly 3 is applied to an steel tube column 1 including an upper portion and a lower portion which are aligned coaxially, and are spaced apart from each other by the space 6. Each of the upper and lower portions comprises a steel tube 25 filled with the continuous concrete body 4.

In this embodiment, the lower connecting member 12 of the connecting device 7 is welded to the upper end of the steel tube 25 of the lower portion of the column 1. Also, the lower end of the steel tube 25 of the upper portion of the column 1 is welded to the upper connecting member 11 of the connecting device 7. Accordingly, the upper steel tube 25, the lower steel tube 25, and the connecting device 7 compose a unitary rigid steel tube body. The steel pipes 25 function as forming molds for the concrete body 4. In addition, the steel tubes 25 function as reinforcements for the steel tube column 1. Consequently, arrangement of the conventional reinforcements 5 in the first embodiment can be omitted. However, such reinforcements may be arranged in a manner similar to the first embodiment, if necessary.

It is clear that either of the connecting members shown in FIGS. 9 and 10 can be utilized for the upper and lower connecting members 11 and 12 of the connecting device 7.

The connecting assembly 3 is assembled in the following manner. First, the connecting device 7 is installed in the steel tube column 1 in such a manner that the concrete is filled into the tubular member 13 so as to form said intermediate portion 1*a*. Next, the ends of the flanges 9 and 10 of the beam 2 are welded to the outer periphery of the upper and lower connecting members 11 and 12, respectively, in such a manner that the upper and lower flanges 9 and 10 are mounted on the projections 17 of the upper and lower connecting members 11 and 12, respectively. Then, the ends of web portions 8 of the beams 2 are also welded to the tubular member 13. Incidentally, the projections 17 can be excluded from one of the connecting members 11 and 12, as mentioned above.

Also, gusset plates (not shown) may be welded to the tubular member 13, and the web portions 8 of the beams 2 are mounted on the gusset plate by nuts and bolts.

In order to install the connecting device 7 to the column 1, the connecting device 7 is disposed on the lower portion of the column 1. Then, the lower connecting member 12 of the connecting device 7 is welded to the upper end of the steel tube 25 of the lower portion of the column 1. Next, the steel tube 25, which will function as a concrete forming mold and will form steel tube portion 25 of the upper portion of the column 1, is coaxially aligned with the steel tube 25 of the lower portion of the column 1. Then, the lower end of the steel tube 25 is welded to the upper connecting member 11 of the connecting device 7. A tremie tube is inserted into the through-hole 16, so that concrete can flow into the space defined by the tubular member 13 and the upper steel tube 25. Consequently, first the tubular member 13 and then the upper steel tube 25 are filled with the concrete 4, thereby constructing the continuous concrete column 1 including said upper, intermediate, and lower portions.

Sixth Embodiment

Figure 6:
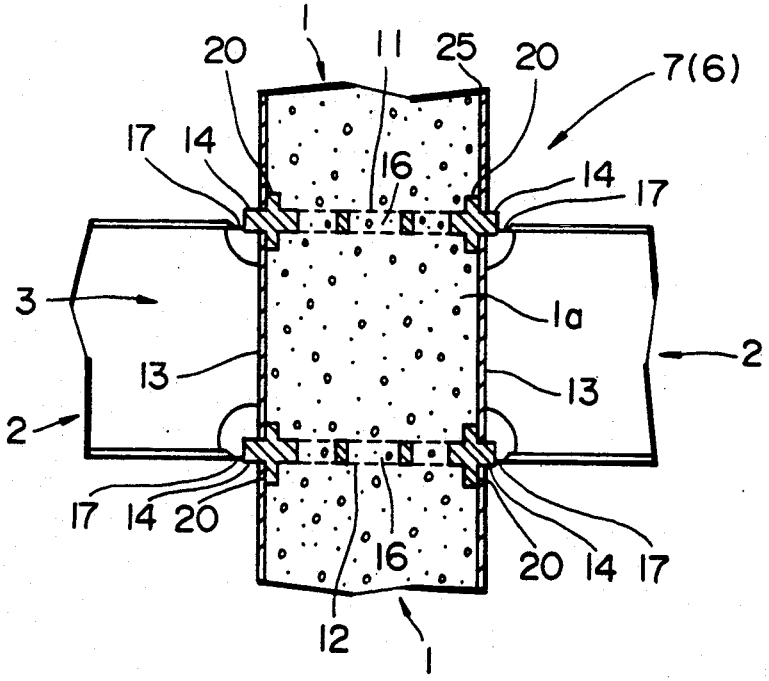
FIG. 6 is a cross sectional view of a connecting assembly between a column and beams in accordance with a sixth embodiment of the present invention.

FIG. 6 shows a sixth embodiment according to the present invention. This embodiment is a modification of the second embodiment shown in FIG. 2. In the sixth embodiment, the connecting assembly 3 is applied to a steel tube column 1 in a manner similar to that in the fifth embodiment.

Seventh Embodiment

Figure 7:
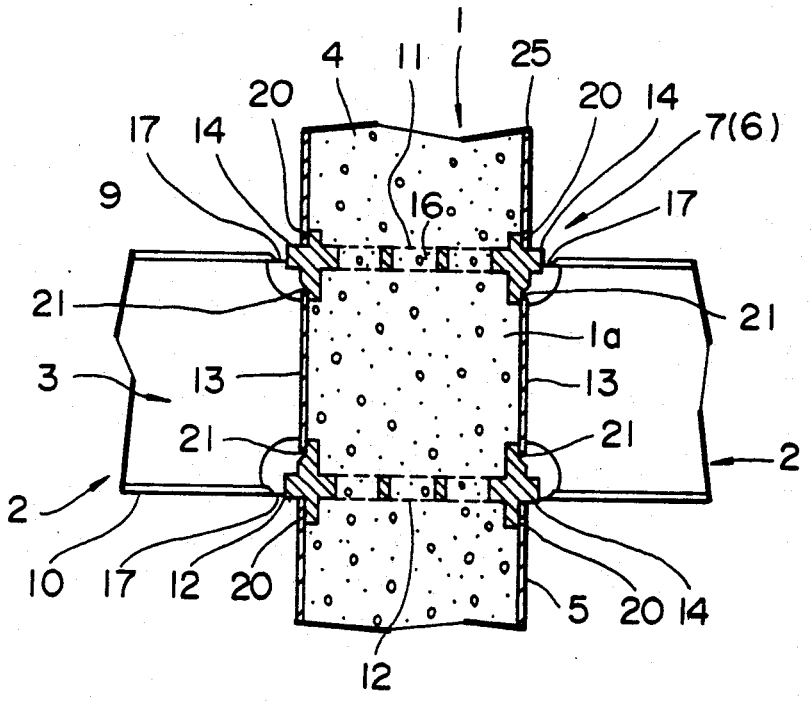
FIG. 7 is a cross sectional view of a connecting assembly between a column and beams in accordance with a seventh embodiment of the present invention.

FIG. 7 shows a seventh embodiment according to the present invention. This embodiment is a modification of the third embodiment shown in FIG. 3. In the seventh embodiment, the connecting assembly 3 is applied to a steel tube column 1 in a manner similar to that in the fifth embodiment.

Eighth Embodiment

Figure 8:
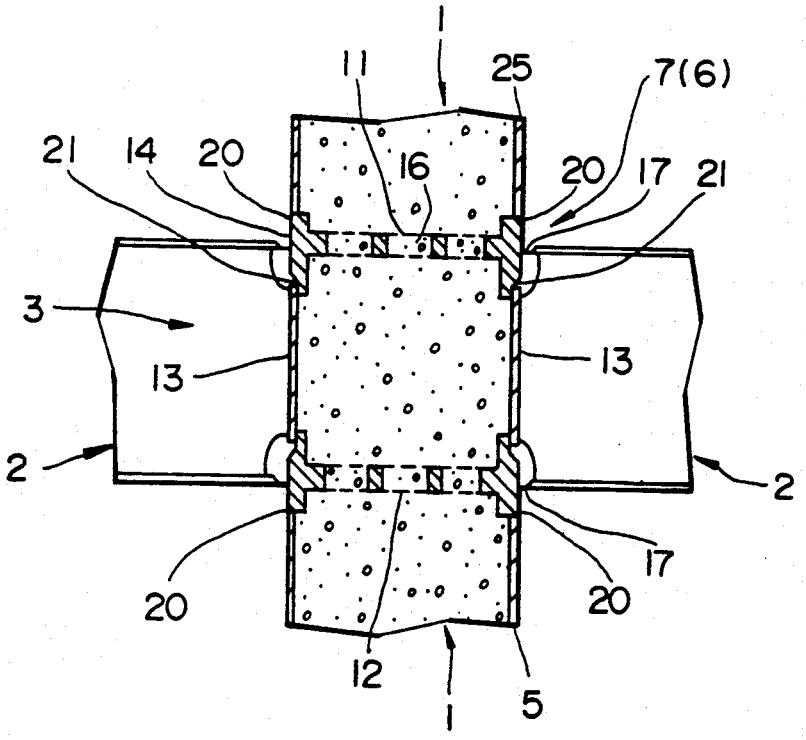
FIG. 8 is a cross sectional view of a connecting assembly between a column and beams in accordance with an eighth embodiment of the present invention.

FIG. 8 shows an eighth embodiment according to the present invention. This embodiment is a modification of the fourth embodiment shown in FIG. 4. In the eighth embodiment, the connecting assembly 3 is applied to a steel tube column 1 in a manner similar to that in the fifth embodiment.

Although preferred embodiments of the present invention have been disclosed for illustrative purpose, those skilled in the art will appreciate that various modifications, additions, and substitutions are possible, without departing from the scope and spirit of the invention as stated in the accompanying claims.

What is claimed is:

1. A connecting assembly between a concrete column which has a periphery defined by concrete, and at least one beam, the beam having an upper flange portion and a lower flange portion, the connecting assembly comprising:

an upper connecting member connected to the upper flange portion of the beam, the upper connecting member having through-holes through which at least one portion of said column is disposed;

a lower connecting member located below the upper connecting member and connected to the lower flange portion of the beam, the lower connecting member having through-holes through which at least one portion of said column is disposed; and means for providing rigidity to the connecting assembly, said providing rigidity means including a tubular member disposed between the upper and lower connecting members, the tubular member encasing at least one portion of said column, said column being connected to said at least one beam, said tubular member being welded to said upper and lower connecting member, said upper and lower connecting members being welded to the upper and lower flange portion of said beam, said beam having a web portion, said tubular member being welded to said web portion, said column comprising reinforcements embedded in a concrete body, the reinforcements being inserted through the through-holes of said upper and lower connecting members and through said tubular member.

each of said upper and lower connecting members comprising at least one axial protrusion extending along an axis of said column.

2. A connecting assembly as recited in claim 1, wherein at least one of said upper and lower connecting members comprises at least one projection protruding laterally from an outer periphery of said connecting members, at least one of said upper flange portion and said lower flange portion of said beam being mounted on said projections of said connecting members.

3. A connecting assembly as recited in claim 2, wherein each of said axial protrusions is provided with an edge preparation, whereby said tubular member is welded rigidly to said upper and lower connecting members.

4. A connecting assembly between a concrete column which has a periphery defined by concrete, and at least one beam, the beam having an upper flange portion and a lower flange portion, the connecting assembly comprising:

an upper connecting member connected to the upper flange portion of beam, the upper connecting member having a least one through-hole through which at least one portion of said column is disposed;

a lower connecting member located below the upper connecting member and connected to the lower flange portion of the beam, the lower connecting member having at least one through-hole through which at least one portion of said column is disposed; and means for providing rigidity to the connecting assembly, said providing rigidity means including a tubular member disposed between the upper and lower connecting members, the tubular member being capable of encasing at least one portion of said column, whereby said column is connectable to said at least one beam.

5. A connecting assembly between a concrete column which has a periphery defined by concrete, and at least one beam, the beam having an upper flange portion and a lower flange portion, the connecting assembly comprising:

an upper connecting member connected to the upper flange portion of the beam, the upper connecting member having through-holes through which at least one portion of said column is disposed;

a lower connecting member located below the upper connecting member and connected to the lower flange portion of the beam, the lower connecting member having through-holes through which at least one portion of said column is disposed;

a tubular member disposed between the upper and lower connecting member, the tubular member encasing at least one portion of said column, whereby said column is connected to said at least one beam, said tubular member being welded to said upper and lower connecting member;

said upper and lower connecting members being welded to the upper and lower flange portion of said beam, said beam having a web portion, said tubular member being welded to said web portion, said column comprising reinforcements embedded in a concrete body, the reinforcements being inserted through the through-holes of said upper and lower connecting members and through said tubular member, each of said upper and lower connecting members comprising at least one axial protrusion protruding along an axis of said column, and at least one rib extending across each of said upper and lower connecting members, said at least one rib of each of said upper and lower connecting members respectively provided in the same direction in which said at least one beam extends.

6. A connecting assembly as recited in claim 5, wherein at least one of said upper and lower connecting members comprises at least one projection protruding laterally from an outer periphery of said connecting members, at least one of said upper flange portion and said lower flange portion of said beam being mounted on said projections of said connecting members.

7. A connecting assembly as recited in claim 6, wherein each of said axial protrusions is provided with an edge preparation, whereby said tubular member is welded rigidly to said upper and lower connecting members.

8. A connecting assembly between a concrete column which has a periphery defined by concrete, and at least one beam, the beam having an upper flange portion and a lower flange portion, the connecting assembly comprising:

an upper connecting member connectable to the upper flange portion of the beam, the upper connecting member having through-holes through which at least one portion of said column is disposed, the upper connecting member having at least one rib, extending across the upper connecting member, disposable in the same direction in which said at least one beam will be extended;

a lower connecting member located below the upper connecting member and connected to the lower flange portion of the beam, the lower connecting member having through-holes through which at least one portion of said column is disposed, the lower connecting member having at least one rib, extending across the lower connecting member, disposable in the same direction in which said at least one beam will be extended; and a tubular member disposed between the upper and lower connecting members, the tubular member being capable of encasing at least one portion of said column, whereby said column is connectable to said at least one beam.

* * * * *